US007549368B2

(12) United States Patent
Heidrich et al.

(10) Patent No.: US 7,549,368 B2
(45) Date of Patent: Jun. 23, 2009

(54) LIGHT-METAL PISTON HAVING HEAT PIPES

(75) Inventors: Peter Heidrich, Sensweiler (DE); Roland Lochmann, Marbach (DE); Klaus Keller, Lorch (DE)

(73) Assignee: Mable International GmbH, Stuttgart (DE)

( * ) Notice: Subject to any disclaimer, the term of this patent is extended or adjusted under 35 U.S.C. 154(b) by 269 days.

(21) Appl. No.: 11/659,985

(22) PCT Filed: Aug. 10, 2005

(86) PCT No.: PCT/DE2005/001410

§ 371 (c)(1),
(2), (4) Date: May 4, 2007

(87) PCT Pub. No.: WO2006/015584

PCT Pub. Date: Feb. 16, 2006

(65) Prior Publication Data

US 2008/0078288 A1 Apr. 3, 2008

(30) Foreign Application Priority Data

Aug. 11, 2004 (DE) ..... 10 2004 038 945

(51) Int. Cl.
*F01B 31/08* (2006.01)
*F01P 1/04* (2006.01)

(52) U.S. Cl. ..... 92/186; 123/41.35

(58) Field of Classification Search ..... 92/186; 123/41.35; 29/888.045
See application file for complete search history.

(56) References Cited

U.S. PATENT DOCUMENTS

| | | | | |
|---|---|---|---|---|
| 5,086,736 | A * | 2/1992 | Wiemann | 92/186 |
| 5,454,351 | A | 10/1995 | Cao et al. | |
| 5,771,776 | A * | 6/1998 | Itoh | 92/186 |
| 7,281,466 | B1 * | 10/2007 | Wilksch et al. | 92/186 |

FOREIGN PATENT DOCUMENTS

| | | |
|---|---|---|
| DE | 762 820 C | 11/1952 |
| DE | 20 00 249 A1 | 9/1971 |

OTHER PUBLICATIONS

International Search Report.

* cited by examiner

*Primary Examiner*—Michael Leslie
(74) *Attorney, Agent, or Firm*—Collard & Roe, P.C.

(57) ABSTRACT

The invention relates to a lightweight piston comprising heat pipes. The aim of the invention is to simplify the structure of such a piston while at the same time allowing for an improved heat dissipation from the piston areas subject to heat load while avoiding thermal stress. For this purpose, a plurality of liquid-filled heat pipes each having an evaporator and a condenser end is used, whereby the evaporator end is configured by short pipe sections that are oriented in the thickness at bottom towards the focal point and that are interlinked by means of a composite heat pipe extending in parallel to the piston head. At least two pipe sections functioning as the condenser end are coupled with the composite heat pipe in such a manner as to configure, by way of a pipe connection arranged on the condenser ends, a closed coolant cycle between the evaporator end, composite heat pipe and condenser end of the heat pipe.

5 Claims, 2 Drawing Sheets

LIGHT-METAL PISTON HAVING HEAT PIPES

CROSS REFERENCE TO RELATED APPLICATIONS

Figure 1:
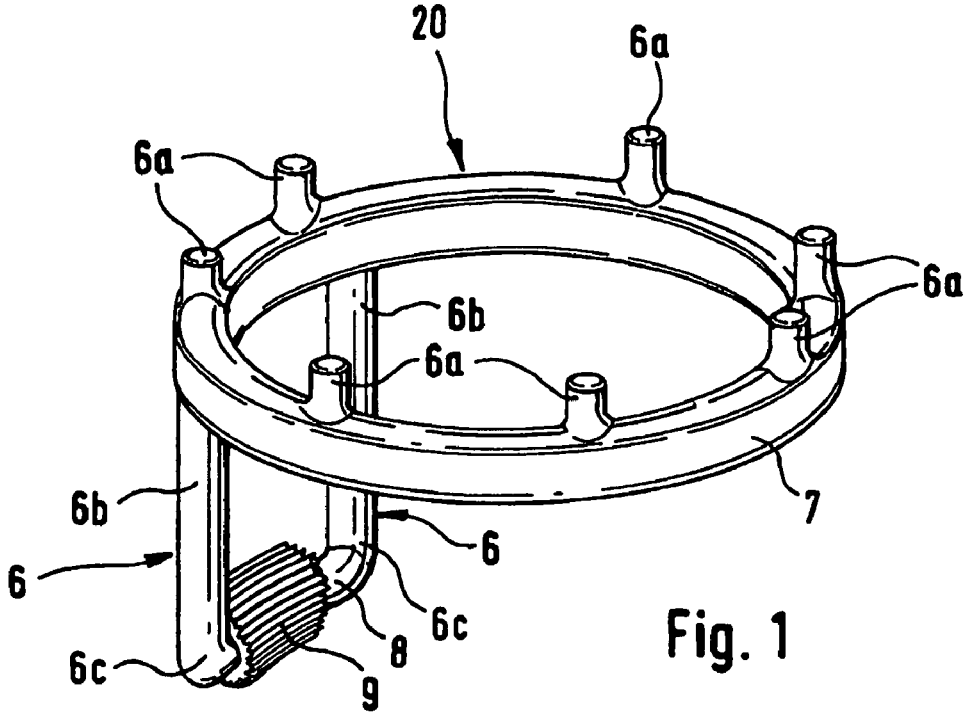

Applicants claim priority under 35 U.S.C. §119 of German Application No. 10 2004 038 945.4 filed Aug. 11, 2004. Applicants also claim priority under 35 U.S.C. §365 of PCT/DE2005/001410 filed Aug. 10, 2005. The international application under PCT article 21(2) was not published in English.

The invention relates to a light-metal piston having heat pipes, having a combustion bowl of suitable crown thickness disposed in the piston crown, having a ring belt, piston skirt, and pin boss for accommodating a piston pin, as well as having a plurality of sealed, liquid-filled heat pipes, provided with an evaporator and condenser side, which are disposed on the circumference, in the vicinity of the ring belt, and directed axially towards the piston axis.

A light-metal piston for an internal combustion engine is known from U.S. Pat. No. 5,454,351, which uses so-called Heat Pipes, in other words heat pipes, for carrying heat away from the hot piston regions, which, sealed off to be air-tight and pressure-tight, contains an easily evaporating cooling fluid, such as preferably water or also ammonia, glycol, or the like. The heat pipes, which consist of copper, are inserted or cast into bores that are evenly distributed on the circumference and made in the piston crown region on the crankshaft side, whereby the bores extend all the way to the height of the ring belt. In the region of the pin bosses, the heat pipes are structured to be slightly bent, in order to allow assembly of the piston pin into the piston. The method of effect of the heat pipes, which is actually known, consists in evaporation of the fluid situated in the heat pipe on the "hot" side—evaporator side—by means of absorption of the heat of the region to be cooled. The steam components formed flow to the "cold" side—condenser side—of the heat pipe, where they go back into the liquid state, giving off their latent heat of evaporation, due to the temperature gradient between hot and cold side. On the cold side, the heat of evaporation is transported out of the crankshaft chamber of the internal combustion engine by means of spraying on cooling oil. In order to guarantee such removal of the heat in the case of a plurality of individual heat pipes, it is necessary to spray all of the heat pipes, and this results in a complicated and cost-intensive piston design.

The invention is based on the task of structuring a light-metal piston of the type stated initially, in such a manner that improved heat removal from the heat-stressed piston regions is achieved, while simplifying the piston design, and thereby the occurrence of thermal stresses is prevented.

This task is accomplished, according to the invention, in that in the case of a plurality of liquid-filled heat pipes provided with an evaporator and condenser side, the evaporator side is formed by short pipe sections that are disposed oriented with the combustion jet, in the crown thickness, towards the piston crown, and connected by means of a composite heat pipe that runs parallel to the piston crown. At least two pipe sections that act as the condenser side are furthermore coupled with the composite heat pipe in such a manner that a continuous, closed process circuit of the cooling fluid between evaporator side, composite heat pipe, and condenser side of the heat pipes is implemented by means of a pipe connection disposed on their condenser-side ends, provided with a ribbing.

Because the pipe connection between the condenser-side pipe sections is configured in such a manner that the ribbing is permanently impacted by a cooling oil jet of an oil nozzle of the internal combustion engine, on the crankshaft side, between the upper dead point and lower dead point of the light-metal piston, an effective and fast heat removal is advantageously achieved at the condenser-side end of the heat pipe. The composite heat pipe, which runs parallel to the piston crown, furthermore assures a uniform temperature distribution along the piston bowl edge, thereby effectively preventing crack formations at the piston crown and bowl edge of the combustion bowl, due to thermal stresses.

Practical embodiments of the invention are the object of the dependent claims.

Figure 2:
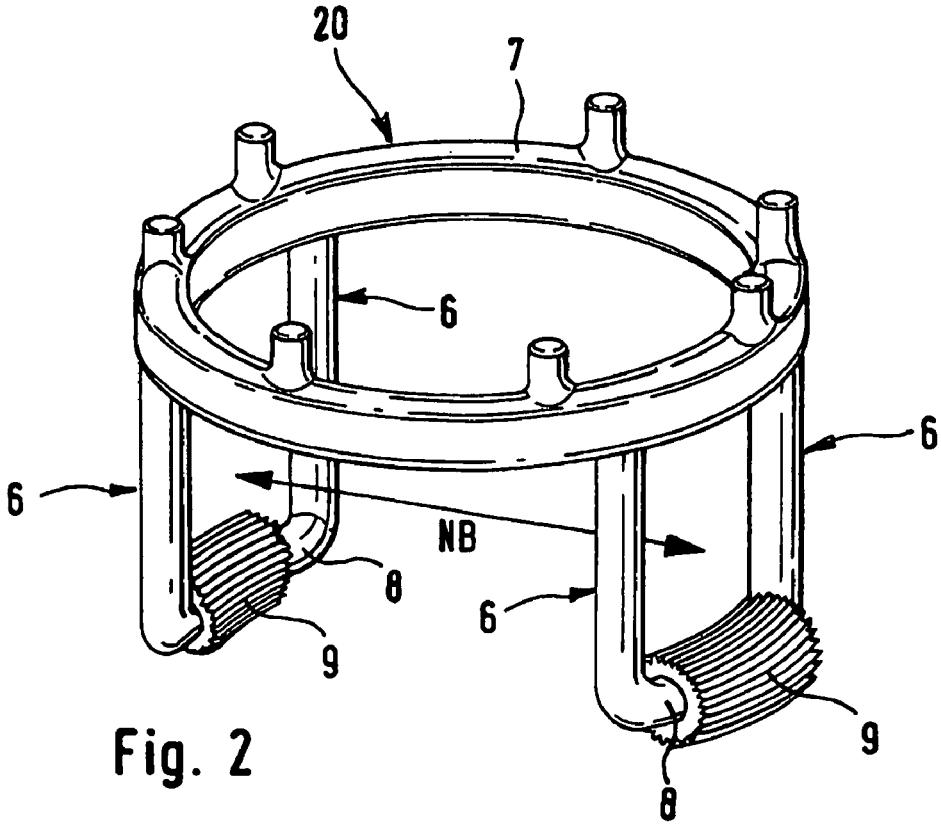
Figure 3:
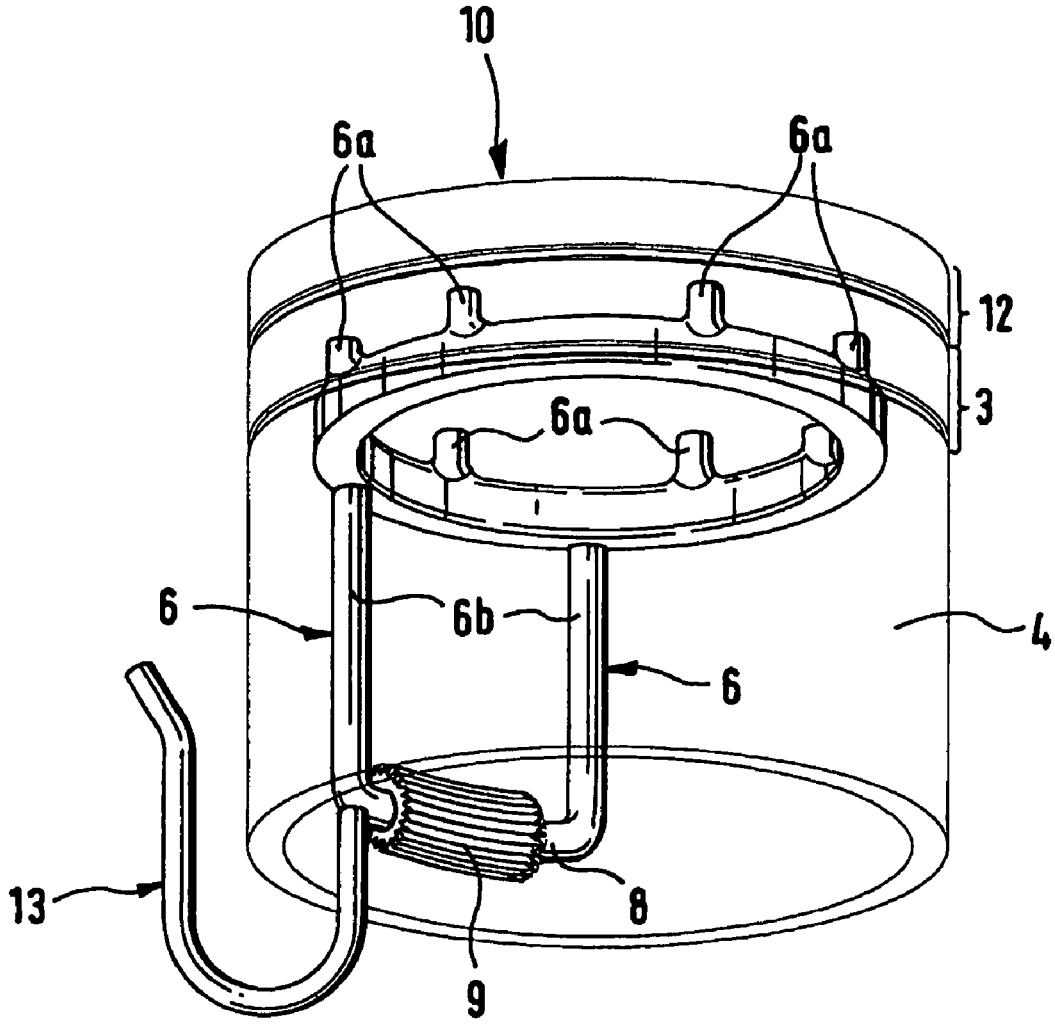

An exemplary embodiment of the invention will be described below, using the drawings. These show FIG. 1 a first embodiment of the cooling system according to the invention, in a light-metal piston;

FIG. 2 a second embodiment of the cooling system according to the invention, in a light-metal piston;

FIG. 3 a perspective view of a light-metal piston, with integrated cooling system according to FIG. 1.

As is evident from FIG. 1, a cooling system 20, which represents a closed cooling circuit, is formed from heat pipes—so-called Heat Pipes 6—having a plurality of evaporator sides 6*a* and at least two condenser sides 6*b*, which are connected by way of a composite heat pipe 7. At the condenser-side end 6*c* of the heat pipes 6*b*, a pipe connection 8 having an outer ribbing 9 provided on the latter is provided, by means of which the condenser-side ends 6*c* of the two heat pipes 6*b* are coupled. For a further enlargement of a heat-radiating surface, additional ribbings (not shown) can also be provided on the condenser sides 6*b* of the heat pipes 6, in addition to the ribbing 9, which also consist of aluminum, in order to reduce the mass. The aforementioned cooling circuit arrangement preferably consists of copper pipes, or can also consist of aluminum pipes, which filled with heat carrier oil or with water provided with an anti-freeze additive, as the cooling fluid. The geometrical dimensions of the cooling system 20 allow its use in aluminum pistons, without any significant change in the required great component strength. As a pre-finished product, the cooling arrangement is laid into a casting mold for the production of an aluminum light-metal piston 10, in order to subsequently produce the piston according to a known casting method. As a result of the similar expansion coefficients between aluminum and copper, no stress problems have been observed during engine operation of a light-metal piston 10 produced in this manner.

In another production variant of the cooling system 20, the composite heat pipe 7 including the evaporator side 6*a* of the heat pipes 6 is implemented by means of a salt core laid into the casting mold, whereby at least two of three bearing sleeves for the salt core serve as connectors for the condenser-side heat pipes 6*b*. By flushing out the salt core, the structure indicated according to FIG. 1 and FIG. 2 is formed in the light-metal piston, without the condenser side 6*b* and pipe connection 8 of the heat pipes 6, which are inserted into the corresponding openings of the composite heat pipe 7 after final machining of the light-metal piston 10, and subsequently soldered or glued in place. Evacuation and filling of the cooling system 20 takes place by way of a bore made in the condenser-side end, which is sealed to be air-tight after the system has been filled with cooling fluid. The cooling fluid, particularly water, must be de-gassed before filling, under vacuum, at a pressure of $10^{-4}$ to $10^{-5}$ bar, in order to prevent cavitation due to the piston movement in the internal combustion engine. At the reversal points of the piston, the cooling fluid accelerates to the opposite side, whereby imploding gas bubbles with accompanying cavitation can occur. It is practical if the cooling system is maximally filled with cooling fluid up to half of its volume.

FIG. 2 shows another exemplary embodiment of the cooling system 20 according to the invention, in which two additional condenser sides 6*b* are made in the cooling system, the circumference-side distribution of which in the light-metal piston takes place in such a manner that two are disposed on the pressure and counter-pressure side, in each instance. The arrow direction NB indicates the progression of the pin bores.

For both exemplary embodiments according to FIG. 1 and FIG. 2 it holds true that the evaporator side 6*a* of the heat pipes are disposed distributed over the circumference of the composite heat pipe 7 in such a manner that these correspond to the distribution of the impact of the combustion jets of the internal combustion engine.

According to FIG. 3, the position of the cooling system in the light-metal piston 10 can be seen. The evaporator sides 6*a*, formed by short pipe sections, are disposed in the crown thickness 11 and oriented with the combustion jet towards the piston crown 1. The composite heat pipe 7 that runs parallel to the piston crown 1 connects the evaporator side 6*a* and at least two pipe sections acting as the condenser side 6*b*, whereby the at least two pipe sections acting as the condenser side 6*a* are disposed at a distance from the piston skirt 4.

The removal of the heat produced by the combustion jets of the internal combustion engine from the piston crown 1, combustion bowl, and the region of the top land 12 as well as the ring belt 3 takes place by way of the outer wall of the evaporator side 6*a* of the heat pipes and of the composite heat pipe 7 to the inner wall, and is absorbed by the cooling fluid, with evaporation of same. The steam components formed flow to the condenser side 6*b* of the heat pipes 6, by way of the composite heat pipe 7, where they go back into the liquid state, giving off their latent heat of evaporation, due to the temperature gradient between evaporator side 6*a* and condenser side 6*b*. On the condenser side 6*b*, specifically the pipe connection 8, the heat of evaporation is transported out of the crankshaft chamber of the internal combustion engine by means of spraying on cooling oil by means of the oil nozzle 13.

Therefore, continuous removal of the heat of evaporation from the heat pipes 6 is guaranteed, during the movement of the piston between upper dead point and lower dead point, by means of the design of the cooling system. Use of the light-metal piston of an AlSi alloy, having the cooling system 20 according to the invention, is particularly suitable for diesel engines.

REFERENCE SYMBOLS light-metal piston 10
cooling system 20
piston crown 1
ring belt 3
piston skirt 4
heat pipe 6
evaporator side 6*a*
condenser side 6*b*
condenser-side end of the composite heat pipe 6*c*
composite heat pipe 7
pipe connection 8
ribbing 9
crown thickness 11
top land 12
oil nozzle 13

The invention claimed is:

1. Light-metal piston (10) having heat pipes, having a combustion bowl (2) of suitable crown thickness disposed in the piston crown (1), having a ring belt (3), piston skirt (4), and pin boss for accommodating a piston pin, as well as having a plurality of sealed, liquid-filled heat pipes (6), provided with an evaporator (6*a*) and condenser side (6*b*), which are disposed distributed on the circumference, in the vicinity of the ring belt (3), and directed axially towards the piston axis (A), wherein the evaporator side (6*a*) of the heat pipes (6) is formed by short pipe sections that are disposed oriented with the combustion jet, in the crown thickness (13), towards the piston crown (1), and connected by means of a composite heat pipe (7) that runs parallel to the piston crown (1);

that at least two pipe sections that act as the condenser side (6*b*) are coupled with the composite heat pipe (7) in such a manner that a continuous, closed process circuit of the cooling fluid between evaporator side, composite heat pipe, and condenser side of the heat pipes (6) is implemented by means of a pipe connection (8) disposed on their condenser-side ends (7*a*).

2. Light-metal piston according to claim 1, wherein the composite heat pipe (6) is disposed at the level of the ring belt (3) between bowl edge and top land (12).

3. Light-metal piston according to claim 1, wherein the at least two pipe sections (6*b*) that act on the condenser side are disposed on the pressure or counter-pressure side, at a distance from the piston skirt (4).

4. Light-metal piston according to claim 3, wherein the pipe connection (8) disposed on the condenser-side ends (6*b*) has an enlargement of the heat-radiating surface by means of a ribbing (9).

5. Light-metal piston according to claim 4, wherein the pipe connection (8) between the pipe sections (6*b*) is configured in such a manner that the ribbing (9) is permanently impacted by a cooling oil jet (14) of an oil nozzle (13) of the internal combustion engine, on the crankshaft side between upper dead point (0T) and lower dead point (UT) of the light metal piston.

* * * * *